US005973585A

United States Patent [19]

Arnhold

[11] Patent Number: 5,973,585

[45] Date of Patent: Oct. 26, 1999

[54] OVERCURRENT TRIP FOR CIRCUIT BREAKERS

[76] Inventor: Hans Arnhold, Bahnhofstrasse 55, D-63755 Alzenau, Germany

[21] Appl. No.: 09/193,924

[22] Filed: Nov. 17, 1998

[30] Foreign Application Priority Data

Nov. 18, 1997 [DE] Germany ..... 197 50 875

[51] Int. Cl.[6] ..... H01H 75/12; H01H 37/52; H01H 37/02

[52] U.S. Cl. ..... 337/13; 337/333; 337/299; 337/3; 337/12; 335/36; 335/35; 335/145

[58] Field of Search ..... 337/333, 299, 337/382, 394, 2, 3, 12, 13, 35, 36, 49, 106, 123, 54; 335/35, 36, 37, 23, 145, 172, 173

[56] References Cited

U.S. PATENT DOCUMENTS

| | | | |
|---|---|---|---|
| Re. 33,400 | 10/1990 | Fuji et al. | 335/26 |
| 4,288,769 | 9/1981 | Howell | 335/173 |
| 4,288,770 | 9/1981 | Gillette | 335/173 |
| 4,595,895 | 6/1986 | Fujii et al. | 335/26 |
| 4,641,001 | 2/1987 | Fujihisa et al. | 200/153 |
| 5,006,826 | 4/1991 | Knoben et al. | 335/35 |
| 5,103,198 | 4/1992 | Morel et al. | 335/6 |
| 5,107,235 | 4/1992 | Torres-Isea | 335/35 |
| 5,499,007 | 3/1996 | Flohr | 335/201 |

FOREIGN PATENT DOCUMENTS

| | | | |
|---|---|---|---|
| 36 37 275 | 11/1986 | Germany . | |
| 410255638A | 9/1998 | Japan | H01H 83/02 |
| 319 008 | 3/1957 | Switzerland . | |
| 2228829A | 9/1990 | United Kingdom | H01H 71/16 |

*Primary Examiner*—Leo P. Picard
*Assistant Examiner*—Anatoly Vortman
*Attorney, Agent, or Firm*—Nilles & Nilles SC

[57] ABSTRACT

An overcurrent trip (1) for circuit breakers or motor safety switches has a very short reaction time. The short reaction time is achieved by connecting a bimetal snap-action disk (8) to the heating device (7) in such a way that its central region is always in contact with the heating device (7), irrespective of creeping movement. This heating device (7) is formed by a ferromagnetic core (5) on which the magnet winding (12) is directly fitted, without a further yoke, which magnetic winding simultaneously serves as the heating winding. The bimetal snap-action disk (8) is held on this heating device (7) with the aid of the electromagnetically actuated rod (21), while a plunger (43) which coaxially surrounds the electromagnetically actuated rod is moved by the bimetal snap-action disk (8).

17 Claims, 2 Drawing Sheets

OVERCURRENT TRIP FOR CIRCUIT BREAKERS

BACKGROUND OF THE INVENTION

1. Field of the Invention

Circuit breakers and motor safety switches are devices which are designed to protect the supply leads or the motor from excess current consumption and hence thermal overload.

In safety devices of this nature, a distinction is drawn between two operating situations. One operating situation is the low-resistance short circuit, in which extremely high currents occur momentarily. These extremely high currents must be cut out very quickly, to which end electromagnetic drives are used. The current from the supply lead or to the motor which is to be protected flows through the magnet winding of an electromagnet which causes an armature to move when a critical current limit value is exceeded, as a result of which the switch contacts are opened.

The other operating situation, which is also intended to lead to a cutout, is where the current rating is exceeded slightly, by comparison with the short circuit, beginning at approximately 20%. The speed at which such an excess current is to be cut out depends on the extent to which the rating is exceeded. The trip time fluctuates between minutes and milliseconds.

Brief and minor excess currents often occur, in particular, for example, when switching on motors and the like, and it is not desirable for this to trip the safety device immediately. On the other hand, it is desirable to suppress the situation where the current rating is exceeded for long periods.

In order to achieve both the time delay and the detection of a current load which lies about 20% above the rating, bimetallic devices which are heated by means of the current flowing through the circuit breaker or the motor safety switch are used in the motor safety switches and in the circuit breakers. These bimetallic devices have, so to speak, an integrating characteristic, in that they detect how long a correspondingly high overcurrent flows for. In doing so, it is necessary to ensure that in the event of the rated current being exceeded considerably but at a level which lies well below that of a short circuit, a relatively quick cutout will be achieved by means of the bimetal component.

With the aid of the bimetal component, it is necessary to cover a current range which begins at approximately 20% above the current rating and extends as far as the lowest current level at which the magnet drive device can become active. The intention is that a very short reaction time of the bimetal component is to be achieved at high current levels.

2. Description of the Related Art

DE 36 37 275 C1 has disclosed an overcurrent trip for safety switches which has a comparatively short reaction time when the rated current is considerably exceeded. The arrangement comprises an iron yoke which is bent in the form of a U and the two limbs of which contain mutually aligned bores. These bores hold an aluminum tube which serves to support a magnet winding which is arranged thereon and is situated between the limbs of the iron yoke. An iron core with a continuous bore, in which a ram is displaceably guided, rests immovably inside the tube. One end of the rod bears against an armature which is also situated in the tube and is held at a distance from the adjoining end side of the iron core with the aid of a helical compression spring.

On one side, the tube merges into a cup-like attachment which is provided with a concave base. This concave base continues into the external end side of the iron core.

In the cup-shaped extension there is a circular bimetal snap-action disk which, at the edge side, is pressed against the base with the aid of a cover which is fitted into the cup. In order to create as good a level of heat transfer as possible, the radius of curvature of the cold bimetal snap-action disk corresponds to the radius of curvature of the base of the cup.

This known arrangement is suitable for monitoring both the short circuit situation and the overcurrent situation. The consumer current flows across the winding and, in the event of a short circuit, a magnetic field is generated which moves the armature towards the fixed iron core, counter to the action of the spring, with the result that the rod is pushed forward and the latching of the trip mechanism of the switch is unlocked.

At the same time, the winding on the aluminum tube serves as a heating winding for the bimetal disk. In the event of an overcurrent which lies above the rating but below the short circuit current, the winding heats the entire magnet yoke until the snap-over temperature of the bimetal snap-action disk is reached. The snap-action disk suddenly snaps over to the opposite direction, thus also pushing the rod toward the trip mechanism, specifically with the aid of an annular shoulder which is arranged on the rod.

This solution, which has proved to be an excellent solution for low rated currents, exhibits problems when used for high rated currents, because the reaction time of the thermal tripping is too long. The heat absorption capacity of the iron yoke, the aluminum tube and the cup is so high that the reaction time is considerably delayed when high overcurrents occur. Moreover, the heat transfer to the snap-action disk is poor. Even at low excess temperatures, the disk begins to creep and to lift off the base of the cup in its central region, with the result that an air gap which impairs the heat transfer is formed between the disk and the base. The heat is only introduced from the edge of the disk, with the result that, combined with the thermal inertia of the magnet device, a reaction performance which is unsuitable in terms of time is produced.

CH 319 008 has disclosed a bimetal snap-action switch which operates with a curved bimetal disk. The housing of the bimetal switch has a base which projects convexly inward and against which the concave side of the bimetal disk bears. A fastening rivet which fixes the bimetal disk to the convex housing base passes through the center of the bimetal disk. The aim of this design is to produce a good level of thermal contact between the bimetal disk and the housing in the at-rest position corresponding to the cold state.

OBJECTS AND SUMMARY OF THE INVENTION

On the basis of the above, the object of the invention is to provide an overcurrent trip which has an improved reaction performance.

As a result of the novel configuration, the central region of the disk bears against the base body, which has a complementary curvature, both in the cold state and in the hot state. In this central region, it is held in bearing contact with the aid of a holding member, so that a good level of thermal contact is always ensured in this region. The heating area in the central region is also not impaired significantly if, on heating, the disk slowly creeps into a state where the radius of curvature is reduced. Since the change in shape before the disk snaps over into the other state is only slight, there is only an extremely minor change in shape in the central region of the disk, and this does not significantly affect the thermal contact. As a result, a good level of thermal coupling is maintained, ensuring a rapid reaction time of the system.

In the novel solution, the trip member is cup-shaped and has a collar which is integrally formed on the base and interacts with the edge of the bimetal snap-action disk. An actuation extension is provided on the trip member.

The structural conditions become particularly simple if the trip member is rotationally symmetrical.

In order to obtain a self-supporting unit which can easily be integrated in an overcurrent switch, a guide device for the trip member is preferably connected to the base body.

If the base body is of ferromagnetic design, it is possible, at the same time, also to integrate the short circuit current monitoring. For this purpose, a winding which at one end projects beyond the base body, allowing a cup-like cavity to be formed, rests on the base body. An armature which is held at a distance from the base body with the aid of a compression spring moves within this cup-like cavity. A rod which passes through a central bore in the base body and at the same time forms the holding member for the snap-action disk is connected to the armature. In this way, additional heat can be introduced into the snap-action disk with the aid of the rod which absorbs heat in the base body.

The magnet winding is advantageously designed in such a way that there is no need for an additional magnet yoke which would impair the thermal inertia of the system so as to delay the reaction time. A further improvement to the reaction time can be achieved if the magnet winding is a self-supporting winding which does not require a support onto which it is wound.

BRIEF DESCRIPTION OF THE DRAWINGS

An exemplary embodiment of the subject matter of the invention is illustrated in the drawing, in which.

DESCRIPTION OF THE PREFERRED EMBODIMENTS

Figure 1:
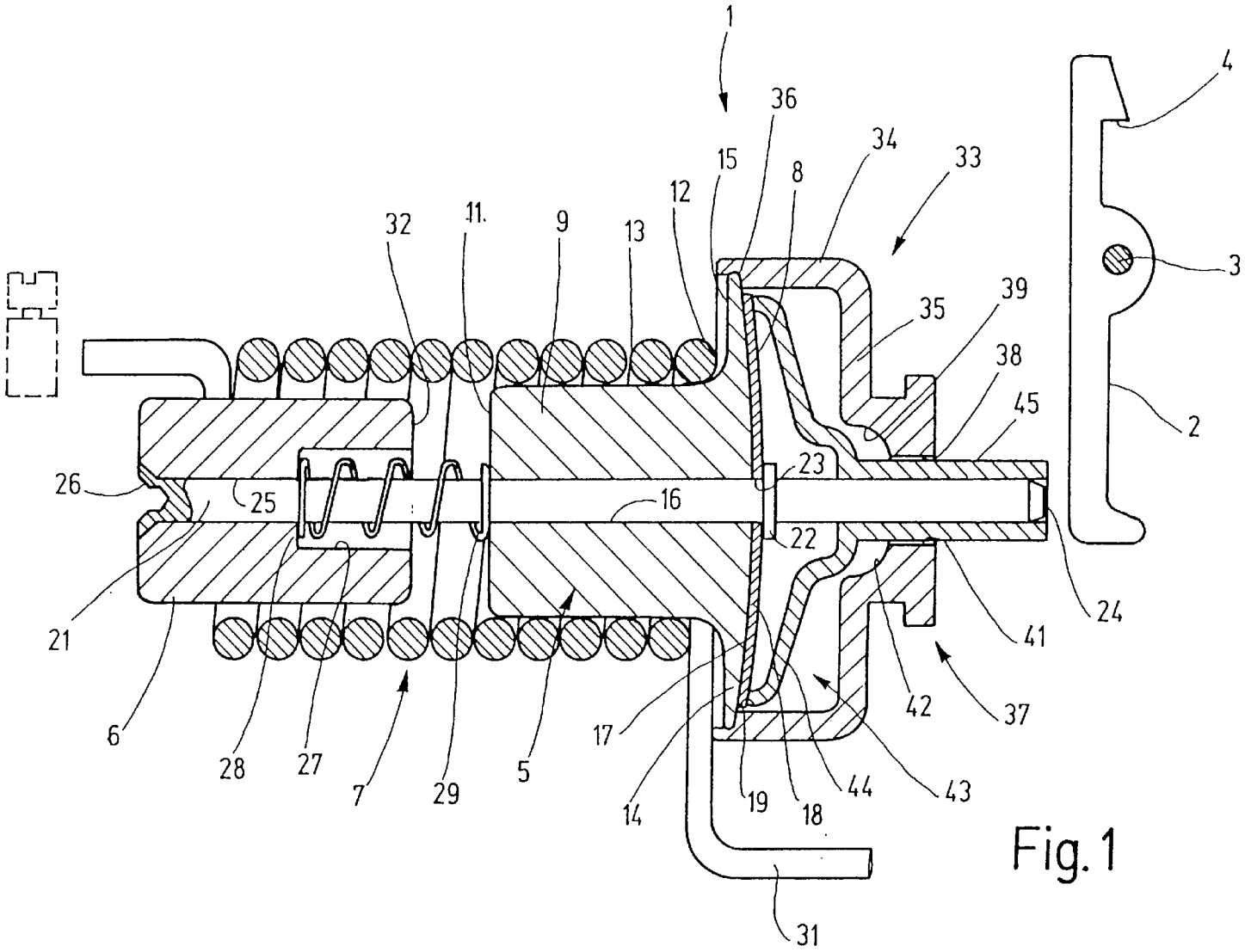
FIG. 1 shows the overcurrent trip according to the invention in longitudinal section parallel to the axis of the rod, in the at-rest position.
Figure 2:
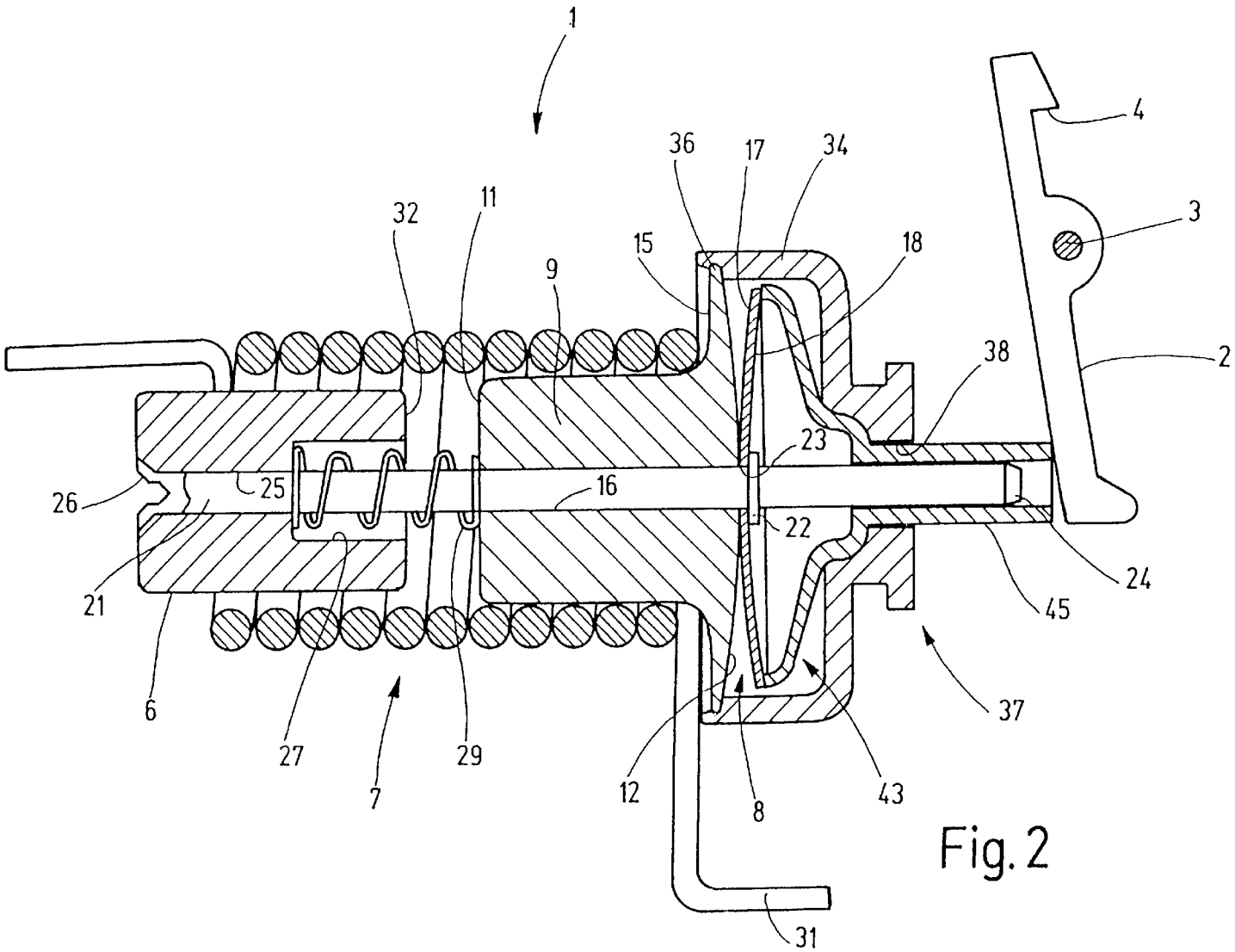
FIG. 2 shows the overcurrent trip in accordance with FIG. 1, in the state after it has been thermally tripped.

FIGS. 1 and 2 each shown a longitudinal section through an overcurrent trip 1 in different operating positions. It is used in a circuit breaker or motor safety switch (not shown in more detail) to unlock the latching of a lever mechanism which, in the normal state, holds switch contacts (not shown in more detail) closed. A two-armed lever 2 which is pivotably mounted on a pin 3 is all that is shown of the lever mechanism. This lever has a hook 4 which maintains the latching.

The overcurrent trip 1 essentially comprises a ferromagnetic core 5 as the base body, an armature 6 which can move with respect to the core, a magnet winding or heating winding 7 and a bimetal snap-action disk 8.

When seen in cross section, the ferromagnetic core 5 is T-shaped and comprises a cylindrical section 9 with an end face 11, which cylindrical section merges into an umbrella-shaped head which forms the other end face 12. The cylindrical section 9 is delimited by a cylindrical outer circumferential surface 13 and, at an end, by the planar end face 11.

The umbrella-shaped head is formed by a rim 14 which projects radially beyond the cylindrical section 9 and is situated at the opposite end from the end face 11. The rim 14 is planar on its underside 15, while the end face 12 has a continuous convex curvature.

A cylindrical bore 16 leads coaxially through the core 5.

The bimetal snap-action disk 8 is arranged on the end face 12. It is formed, in a known manner, as a circular disk which is composed of two thin metal plates and is delimited by two mutually parallel flat sides 17 and 18 and an edge 19. It is in the form of a spherical cap.

The bimetal snap-action disk 8 is able to change its physical form suddenly when heated. The flat side 17, which is concave in the cold state, curves out convexly in the hot state, with the result that the opposite flat side 18 becomes concave. The process is reversible.

In order to provide a good level of thermal contact between the bimetal snap-action disk 8 and the end face 12, the radius of curvature of the end face 12 corresponds to the radius of curvature of the flat side 17 when the bimetal snap-action disk 8 is at room temperature, i.e. is cold.

A cylindrical rod 21, which is provided with an annular shoulder 22 in the region of its front section, passes through the bore 16. The rod 21 also passes through a central bore 23 in the bimetal snap-action disk 8.

The rod 21 projects beyond the shoulder 22 and has a free actuation end 24 at the front, which actuation end is designed to come into engagement with the lever 2.

The rear end of the rod 21 passes through a bore 25 in the cylindrical armature 6. In order to connect the armature 6 fixedly to the rod 21, the rod 21 is riveted to the armature 6 by means of a closure head 26 which is forced on.

At the end facing the core 5, the bore 25 in the armature 6 merges into a widened section 27 which is delimited by a shoulder 28. The shoulder 28 forms a stop face for a helical compression spring 29, the other end of which is supported against the end face 11 of the core 9. In this way, the annular shoulder 22 is held in contact, with the aid of the helical compression spring 29, with the bimetal snap-action disk 8, which in turn is consequently pressed against the end face 12. Moreover, the spring 29 holds the armature 6 at a distance from the core 5, with the result that an axial air gap, the length of which corresponds to the actuation travel, is formed between the armature and the core.

The external diameter of the armature 6 is smaller than the diameter of the cylindrical section 9.

The cylindrical outer surface 13 of the core 9 serves as a seat face for the magnet winding or heating winding 7, which comprises a suitably dimensioned hard copper wire 31 which, in a number of turns, is wound into a cylindrical coil. The length of this coil 7 is dimensioned in such a way that it is approximately twice as long as the distance between the end face 11 of the core 5 and the underside 15 of the rim 14. As a result, a sufficiently large cylindrical, cup-shaped inner chamber, which is delimited by the inner side of the coil 7 and the end face 11, remains in order to accommodate the armature 6 which, in the at-rest position, is situated with its end side 32 at a distance from the end side 11.

A cup-shaped guide member 33, with a cylindrical, tubular collar 34 and a base 35, is arranged in front of the end side 12. In the free end of the tubular collar 34, there is an annular recess 36, by means of which the tubular collar 34 engages around the outside of the disk-like rim 14 of the core 5 and is held on this rim by means of a bead which cannot be seen.

A neck part 37 which contains a stepped bore 38 runs from the base 35. The stepped bore 38 has a section 39 with a relatively large diameter and a cylindrical section 41 with a smaller diameter, which sections merge into one another at a rounded shoulder 42. The bore 38 is coaxial with respect to the tubular collar 34 and is therefore aligned with the axis of the bore 16 in the ferromagnetic core 5.

The guide part 38 serves as a guide for a cup- or bell-shaped plunger of a trip member 43, the external diameter of which corresponds to the external diameter of the bimetal snap-action disk 8 and the bell-shaped collar 44 of which bears against the edge 19 of the bimetal snap-action disk 8. Further inward, in the radial direction, the bell-shaped collar 44 merges into a tubular actuation extension 45 which is cylindrical and the external diameter of which corresponds to the clear width inside the section 41 of the bore 38. The rod 21 passes through the tubular actuation extension 45, the length of the rod 21 and of the tubular actuation extension 45 being dimensioned to be such that they both end approximately flush with one another.

The overcurrent trip 1 shown operates and functions as follows:

In the at-rest position, the spring 29 pushes the armature 6 away from the iron core 5. This pushing movement is limited by the annular shoulder 22 coming into contact with the bimetal snap-action disk 8, which as a result, owing to the spring force, is pressed against the end face 12. The plunger 43 is freely movable and has a small weight, so that in the switched-on state it is not able to trip the latching of the circuit breaker.

The current between the current source and the consumer flows through the copper wire 31 and therefore through the coil 7 which this wire forms. The current flowing through the copper wire 31 has two functions. One function consists in heating the ferromagnetic core proportionately to the current and, moreover, in generating a magnetic field in the air gap between the ferromagnetic core 5 and the ferromagnetic armature 6. Both the magnetic field and the heating action are proportional to the current.

As long as the current passing through the coil 7 remains below the rating for which the overcurrent trip 1 is dimensioned, temperatures which are sufficient for the snap-action disk 8 to snap over do not occur. The magnetic field is also not sufficient to attract the armature 6. However, as soon as a short circuit occurs in the circuit which is monitored by the circuit breaker having the overcurrent trip 1 shown, the current rises to over one hundred times the rated current or even higher. As a result, a magnetic field is formed in the axial air gap between the ferromagnetic core 5 and the armature 6 which has such a strength that the force of the spring 29 is overcome and the armature 6 is attracted onto the ferromagnetic core 5. The movement of the armature 6, to the right with regard to FIG. 1, also pushes the rod 21, which is fixedly connected thereto, to the right onto the lever 2 which as a result, as shown in FIG. 2, is pivoted and releases the latching, with the result that suitable spring drives open the switch contacts (not shown) of the circuit.

After the short circuit current has disappeared, the armature 6 returns to the at-rest position shown and the circuit breaker must be reset manually.

If the current lies only 20% above the rating, the armature remains in the at-rest position, as shown in FIG. 1. However, the coil 7, which is now acting predominantly as a heating winding, generates a temperature which lies above the temperature at which the bimetal snap-action disk 8 snaps over from the shape shown in FIG. 1 to the shape shown in FIG. 2, i.e. the flat side 18 changes from a convex shape to a concave shape. The temperature generated by the winding 7 gradually progresses toward the bimetal snap-action disk 8, with the rate of progress being relatively quick, because the heat capacity of the ferromagnetic core 5 is low owing to its small volume. This core has a comparatively small volume and therefore can be heated up correspondingly quickly. It transfers its heat, via the end face 12, over a large surface area, to the bimetal snap-action disk 8 which is bearing closely against the end face 12. Owing to the spring action, it is pressed resiliently against the end face 12.

Bimetal snap-action disks 8 of the type shown have the property of creeping, i.e. the radius of curvature of the concave side changes slightly even before the disks snap over into the other shape. Therefore, as the heating increases, the edge 19 of the bimetal snap-action disk 8 will lift off the end face 12 slightly. However, since the central region of the bimetal snap-action disk 8 is held fixedly against the end face in the vicinity of the bore 23, the result remains a good level of thermal contact as before, in particular in the central region, which is critical for the snap-action disk 8, a fact which is important if the bimetal snap-action disk is to react quickly.

As soon as the snap-over temperature is exceeded, the bimetal snap-action disk 8 suddenly snaps over from the position shown in FIG. 1 into the position shown in FIG. 2, in which its edge 19 is at a considerable distance from the end face 12. As a result, the trip member 43, the bell-shaped collar 44 of which bears against the edge 19 of the bimetal snap-action disk 8, is pushed forward away from the core 5, i.e. toward the lever 2, which is pivoted and releases the latching in the switch. Since the circuit is now broken, the heating action ceases and the bimetal snap-action disk 8 cools down and returns to the position shown in FIG. 1. From there, the switch can be reset.

In the novel solution shown, the bimetal snap-action disk 8 has a very good level of thermal contact with the ferromagnetic core 5 in its central region even in the event of creeping movements. Owing to the absence of an external yoke or of a separate coil support with a high heat capacity, the arrangement as a whole has a very low heat capacity. As a result, it is possible for the overcurrent switch 1 to achieve a very rapid thermal response, specifically in those current ranges which lie below the current at which the armature 6 is moved as a result of magnetic forces but which, on the other hand, lie considerably above the rated current.

The good level of heat transfer to the bimetal snap-action disk 8 is also additionally improved by the rod 21 which, via the annular shoulder 22, provides heat from the interior of the core 5 to the opposite flat side of the bimetal snap-action disk 8.

An overcurrent trip for circuit breakers or motor safety switches has a very short reaction time. The short reaction time is achieved by connecting a bimetal snap-action disk to the heating device in such a way that its central region is always in contact with the heating device, irrespective of creeping movements. This heating device is formed by a ferromagnetic core on which the magnet winding, which simultaneously serves as the heating winding, is directly fitted without a further yoke. The bimetal snap-action disk is held on this heating device with the aid of the electromagnetically actuated rod, while a plunger which coaxially surrounds the electromagnetically actuated rod is moved by the bimetal snap-action disk.

I claim:

1. An overcurrent trip (1) for electric safety switches, in particular circuit breakers or motor safety switches, having a base body (5) which has a convexly curved end face (12), having an electrical heating winding (7) which is situated on the base body (5) and is designed to have the current which is to be monitored flowing through it, having a bimetal snap-action disk (8) which has an edge (19) and has two temperature-dependent curvature states, which are such that, in the cold state, the disk is curved concavely on one flat side (17), and, in the hot state, the disk is curved convexly on this flat side (17), and the central region of which disk is held so as to bear against the end face (12) of the base body (5), in such a manner that its flat side (17), which is concave in the cold state, faces the end side (12) of the base body (5) while the edge (19) of the bimetal snap-action disk (8) is freely movable, having a holding member (21) by means of which the bimetal snap-action disk (8) is held so as to bear against the base body (5), and having a trip member (43) which is designed to interact with the edge region (19) of the bimetal snap-action disk (8).

2. The overcurrent trip as claimed in claim 1, wherein the bimetal snap-action disk (8) is circular.

3. The overcurrent trip as claimed in claim 1, wherein the trip member (43) is cup-shaped and has a collar (44) and a base, the collar (44) of said trip member bearing against the edge region (19) of the bimetal snap-action disk (8).

4. The overcurrent trip as claimed in claim 1, wherein the trip member (43) bears an actuation extension (45).

5. The overcurrent trip as claimed in claim 4, wherein the actuation extension (45) is arranged on the base of the trip member (43) and points in the opposite direction from the collar (44).

6. The overcurrent trip as claimed in claim 4, wherein the trip member (43) is rotationally symmetrical.

7. The overcurrent trip as claimed in claim 5, wherein the actuation extension (45) is tubular.

8. The overcurrent trip as claimed in claim 1, wherein a guide device (33) for the trip member (43) is connected to the base body (5).

9. The overcurrent trip as claimed in claim 1, wherein the base body (5) is ferromagnetic.

10. The overcurrent trip as claimed in claim 1, wherein the heating winding (7) forms a magnetic winding.

11. The overcurrent trip as claimed in claim 1, wherein the base body (5) contains a bore (16) in which a rod (21) is guided in a longitudinally displaceable manner.

12. The overcurrent trip as claimed in claim 11, wherein the rod (21) passes through the bimetal snap-action disk (8).

13. The overcurrent trip as claimed in claim 11, wherein the rod (21) forms the holding member.

14. The overcurrent trip as claimed in claim 11, wherein the rod (21) has a shoulder (22).

15. The overcurrent trip as claimed in claim 11, wherein the rod (21) is connected to a ferromagnetic armature (6).

16. The overcurrent trip as claimed in claim 11, wherein the rod (21) is preloaded against the bimetal snap-action disk (8) in the direction towards the bearing contact.

17. The overcurrent trip as claimed in claim 1, wherein the trip member (43) is freely movable.

* * * * *